US007004784B2

(12) United States Patent
Castle

(10) Patent No.: US 7,004,784 B2
(45) Date of Patent: Feb. 28, 2006

(54) TAMPER DETECTION FOR SECURITY SYSTEM

(75) Inventor: Scott T. Castle, Canandaigua, NY (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/787,629

(22) Filed: Feb. 26, 2004

(65) Prior Publication Data

US 2005/0191878 A1 Sep. 1, 2005

(51) Int. Cl.
*H01R 3/00* (2006.01)

(52) U.S. Cl. ..... 439/489; 340/693.11

(58) Field of Classification Search ..... 439/489; 340/693.11, 568.1, 571, 500, 427, 542, 568, 340/547, 693
See application file for complete search history.

(56) References Cited

U.S. PATENT DOCUMENTS

| | | | | |
|---|---|---|---|---|
| 4,092,641 | A | 5/1978 | Bellinghausen et al. | 340/409 |
| 4,138,674 | A | 2/1979 | Humphries | 340/506 |
| 4,201,982 | A | 5/1980 | Humphries | 340/506 |
| 4,295,132 | A | 10/1981 | Burney et al. | 340/562 |
| 4,369,436 | A | 1/1983 | Lautzenheiser | 340/506 |
| 4,451,733 | A | 5/1984 | Avery et al. | 250/342 |
| 4,709,151 | A | 11/1987 | Guscott et al. | 250/342 |
| 4,710,629 | A | 12/1987 | Muller et al. | 250/342 |
| 5,057,816 | A | 10/1991 | Kostusiak | 340/506 |
| 5,077,548 | A | 12/1991 | Dipoala | 340/522 |
| 5,450,062 | A | 9/1995 | DiPoala | 340/552 |
| 5,748,083 | A | 5/1998 | Rietkerk | 340/568 |
| 5,801,632 | A | 9/1998 | Opal | 340/585 |
| 5,831,529 | A | 11/1998 | Pantus | 340/555 |
| 5,942,976 | A | 8/1999 | Wieser et al. | 340/565 |
| 6,297,745 | B1 | 10/2001 | Meier | 340/693.11 |
| 6,377,174 | B1 | 4/2002 | Siegwart et al. | 340/541 |

FOREIGN PATENT DOCUMENTS

| | | |
|---|---|---|
| EP | 0 834 847 A1 | 4/1998 |
| EP | 0 918 450 A2 | 5/1999 |
| GB | 2 233 486 A | 1/1991 |
| GB | 2 304 222 A | 3/1997 |

OTHER PUBLICATIONS

Installation Instructions for the AE20 Universal Enclosure, 2004 Bosch Security Systems, 2 pages.
Copy of European Search Report mailed Jul. 15, 2005 in related European application.

*Primary Examiner*—Javaid H. Nasri
(74) *Attorney, Agent, or Firm*—Baker & Daniels LLP

(57) ABSTRACT

A security device mounted on a support including a housing with a removable section and a base section. A terminal assembly having first and second terminals is disposed on a detachable portion of the housing that is directly mounted to the support. A printed circuit board and a pin assembly having first and second pins is mounted in the removable housing section. Attaching the removable housing section to the device inserts the first and second pins into the first and second terminals respectively. A conductive material provides electrical communication between the first and second pins whereby a tamper detection circuit can be defined between the first and second terminals. Disengagement of one of the first and second pins from its respective terminal opens the tamper detection circuit. Detachment of the removable housing section disengages the pins from the terminals thereby opening the tamper detection circuit. Similarly, separation of the detachable portion and terminal assembly disposed thereon from the remainder of the device also opens the tamper detection circuit.

15 Claims, 3 Drawing Sheets

TAMPER DETECTION FOR SECURITY SYSTEM

BACKGROUND OF THE INVENTION

1. Field of the Invention

The present invention relates to the detection of tampering or sabotage to a surveillance system such as an intrusion detection system or other system for which the detection of tampering or sabotage is desired.

2. Description of the Related Art

Surveillance systems such as intrusion detection systems may employ microwave radar systems and/or infrared sensors to detect the presence of an intruder in a protected space and typically generate an alarm signal, such as an electrical signal communicated to a central monitoring station, when an intruder is detected within the protected space. To defeat such surveillance systems, intruders may try to tamper with or sabotage the system so that it will not generate an alarm signal when the intruder enters the protected space.

Intrusion detection system typically employ a number of different individual motion detectors that are mounted on a building structure such as a wall of the building. When an intruder seeks to tamper with such a detector, they may remove the cover or the entire unit from the wall. Although various methods of detecting such tampering with individual detectors have been developed, an improved, reliable and cost effective method of detecting such tampering is desirable.

SUMMARY OF THE INVENTION

The present invention provides a reliable and cost-effective system for detecting the tampering or sabotage of a security device. It is capable of detecting when the device has been forcibly removed from the wall, or other support, on which it has been mounted and when the housing of the device has been opened.

The invention comprises, in one form thereof, a security device mountable on a support. The device includes a housing having a first section and a second section wherein the second housing section is removably attachable to the device. The device also includes a terminal assembly including at least a first terminal and a second terminal and a pin assembly having at least a first conductive pin and a second conductive pin. Each of the first and second pins are respectively insertable into the first and second terminals defined by the terminal assembly. Electrical contact between the first and second pins and the first and second terminals is respectively established by insertion of the first and second pins in the first and second terminals. A conductive material provides electrical communication between the first and second pins wherein insertion of the first and second pins in the first and second terminals defines a tamper detection electrical circuit between the first terminal and the second terminal and removal of one of the first and second pins from the first and second terminals opens the tamper detection circuit. The first housing section also includes a detachable portion. The detachable portion is securable to the support and the terminal body is disposed on the detachable portion The pin assembly is disposed on the second housing section Attachment of the second housing section to the security device inserts the first and second pins in the first and second terminals and detachment of the second housing section disengages the first and second pins from the first and second terminals. Removal of the security device from the support by detachment of the first housing section from the detachable portion disengages the pin assembly from the terminal assembly.

The detachable portion may be formed integrally with the first housing section wherein the detachable portion defines an outer perimeter that is connected to a remainder of the first housing section by a frangible web of material. Such a first housing section and integral detachable portion may be formed by injection molding a plastic material. The detachable portion may also include an aperture whereby the detachable portion is securable to the support by inserting a fastener through the aperture.

The invention comprises, in another form thereof, a tamper detection method for a security device mountable on a support. The method includes providing a housing for the security device wherein the housing includes a first housing section and a removably attachable second housing section, providing the first housing section with a detachable portion having a terminal assembly disposed thereon wherein the terminal assembly includes at least a first terminal and a second terminal and securing the detachable portion to the support. The method also includes providing the second housing section with a pin assembly having at least a first conductive element and a second conductive element wherein the first and second conductive elements are in electrical communication and attaching the second housing section to the security device wherein the step of attaching the second housing section includes establishing electrical contact between the first and second conductive elements and the first and second terminals respectively thereby defining a tamper detection circuit between the first terminal and the second terminal. The tamper detection circuit is monitored and tampering is detected when the tamper detection circuit is opened. The tamper detection circuit is opened by the disengagement of one of the first and second conductive elements from the first and second terminals. Removal of the security device from the support by detachment of the first housing section from the detachable portion disengages the first and second conductive elements from the first and second terminals and detachment of the second housing section from a remainder of the security device also disengages the first and second conductive elements from the first and second terminals.

The method may also include the step of connecting a first conductive member to the first terminal and a second conductive member to the second terminal and monitoring the tamper detection circuit for opening of the circuit at a location remote from the security device.

The invention comprises, in yet another form thereof, a security device mountable on a support. The device includes a housing having a removable section and a detachable portion directly secured to the support A terminal assembly including at least a first terminal and a second terminal is disposed on the detachable portion A first conductive element and a second conductive element are mounted in the removable section of the housing and a conductive material provides electrical communication between the first and second conductive elements. The first and second elements are respectively engageable with the first and second terminals by attachment of the removable housing section to the device wherein respective engagement of the first and second elements with the first and second terminals defines a tamper detection circuit between the first and second terminals and wherein disengagement of one of the first and second elements from a respective one of the first and second terminals opens the tamper detection circuit. Detachment of the removable section of the housing disengages the first and second elements from the first and second terminals and detachment of the detachable portion also disengages the first and second elements from the first and second terminals.

An advantage of the present invention is that it provides a reliable and cost effective system for determining whether the housing of a security device has been opened or whether the device has been forcibly removed from its support.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
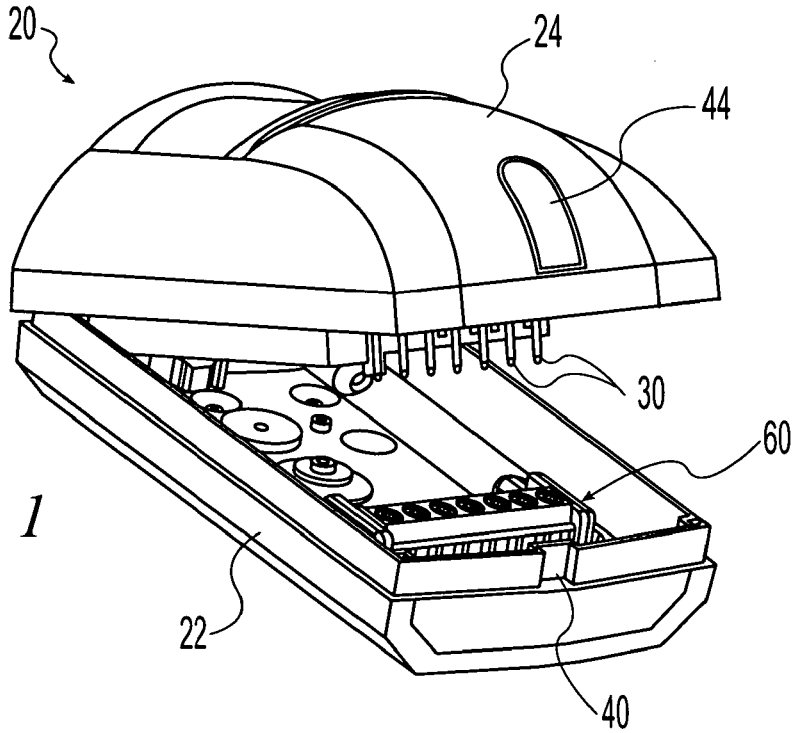
FIG. 1 is an exploded view of a security device in accordance with the present invention

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

A security device 20 in accordance with the present invention is shown in FIG. 1. Security device 20 includes a first housing section 22 and a second housing section 24. In the illustrated embodiment security device 20 is an intrusion detection system that employs both passive infrared (PIR) sensors and microwave radar. Such dual technology intrusion detection devices are known to those having ordinary skill in the art. Various other forms of intrusion detection devices, which do not necessarily include both a PIR sensor and microwave radar, may also be employed with the present invention. Examples of intrusion detection systems that may be used with the present invention are described by DiPoala in U.S. Pat. Nos. 5,450,062 and 5,077,548 respectively entitled "Detection System With Reduced Sensitivity To Pin Diode Effect" and "Dual Technology Intruder Detection System With Sensitivity Adjustment After 'Default'" both of which are hereby incorporated herein by reference.

Figure 2:
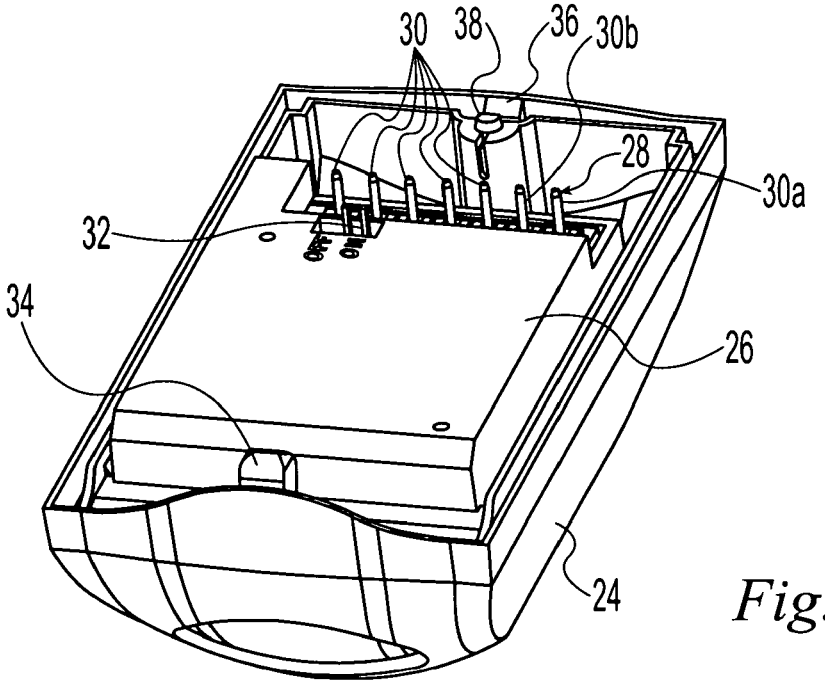
FIG. 2 is a view of the outer housing section and components of the device of FIG. 1.

The electronic components that perform the intrusion detection sensing, in the illustrated embodiment, are either formed on printed circuit board (PCB) 26 or mounted on PCB 26 and located between PCB and second housing section 24. The PCB 26 is secured to and mounted on the interior portion of second housing section 24. As can be seen in FIG. 2, PCB 26 includes a pin assembly 28 which includes a plurality of conductive elements 30. More specifically, conductive elements 30 are formed by seven conductive pins. The conductive pins 30, include a first pin 30*a* and a second pin 30*b* which are used in the tamper detection system as discussed in greater detail below. Also shown on the back side of PCB 26 visible in FIG. 2 is a switch 32. Switch 32 is used to toggle on and off a status indicating LED which is visible on both the rear of PCB 26 and the front surface of second housing section 24 and is not directly pertinent to the present invention.

Second housing section 24 is removably mountable on first housing section 22. As seen in FIG. 2, a hook member 34 located on one end of second housing section 24. On the end of second housing section 24 opposite hook 34, a latching mechanism having a projection 36 and a locking member 38 are provided. When mounting second housing section 24 to first housing section 22, hook member 34 is positioned in recessed area 42 (FIG. 3) with second housing section 24 positioned at an angle to first housing section 22 as exemplified in FIG. 1. Second housing section 24 is then pivoted to position wedge-shaped projection 36 within recess 40 in a snap-fit engagement. Locking member 38 includes a flat portion that is positioned facing projection 36 during the mounting of second housing section 24 onto first housing section 22. After the snap-fit engagement of projection 36 with recess 40, locking member 38 is rotated to firmly engage the bottom wall of recess 40 between projection 36 and locking member 38. Locking member 38 has a head (not shown) disposed in a recess concealed by a cover 44 hingedly mounted on the outer surface of second housing section 24. To turn locking member 38, cover 44 is pivoted to provide access to locking member 38 and a screwdriver or other tool is used to turn locking member 38 and thereby firmly secure second housing section 24 to first housing section 22.

Figure 4:
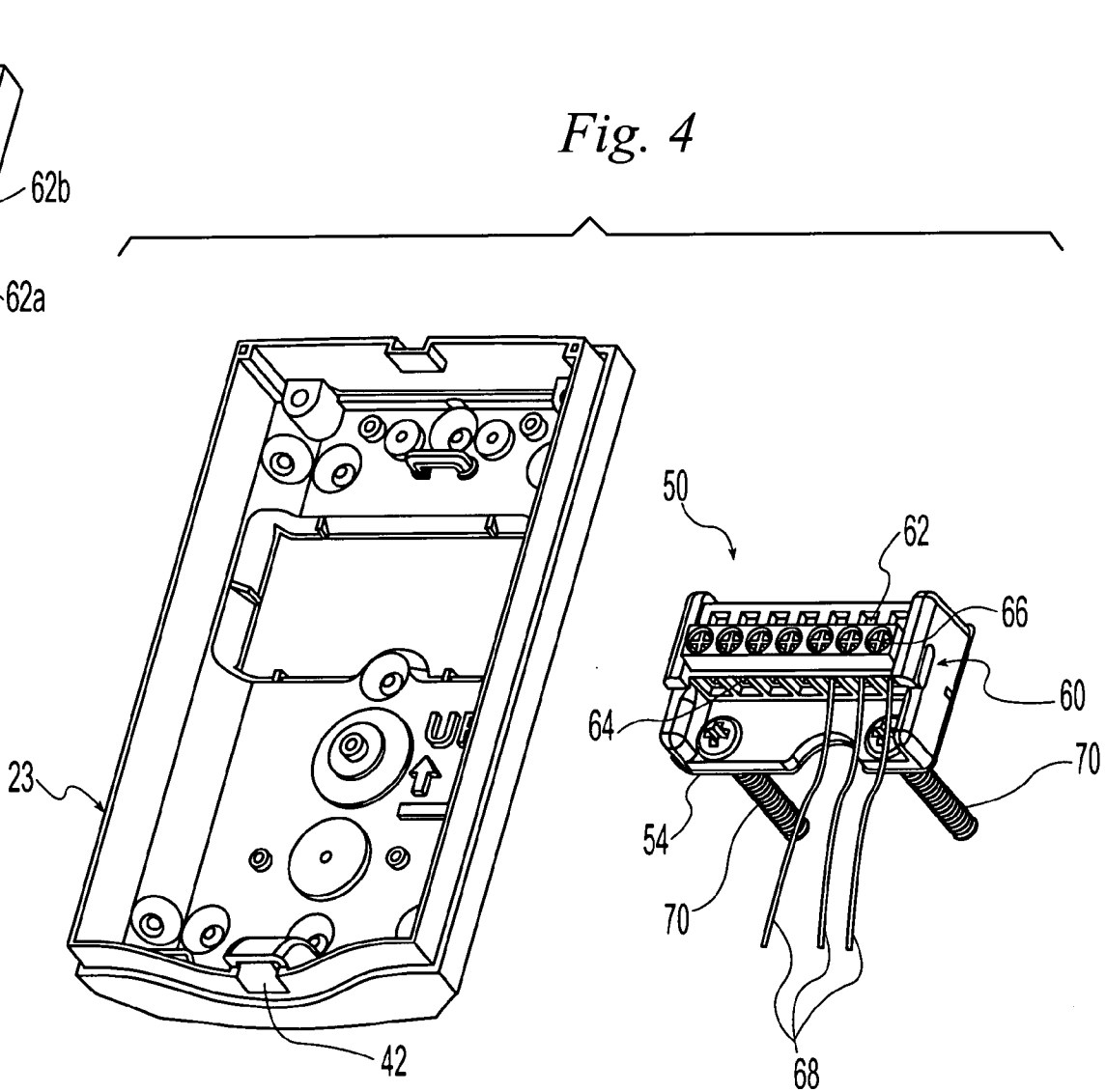
FIG. 4 is a view of the base housing of the device of FIG. 1 after it has been subjected to tampering.
Figure 3:
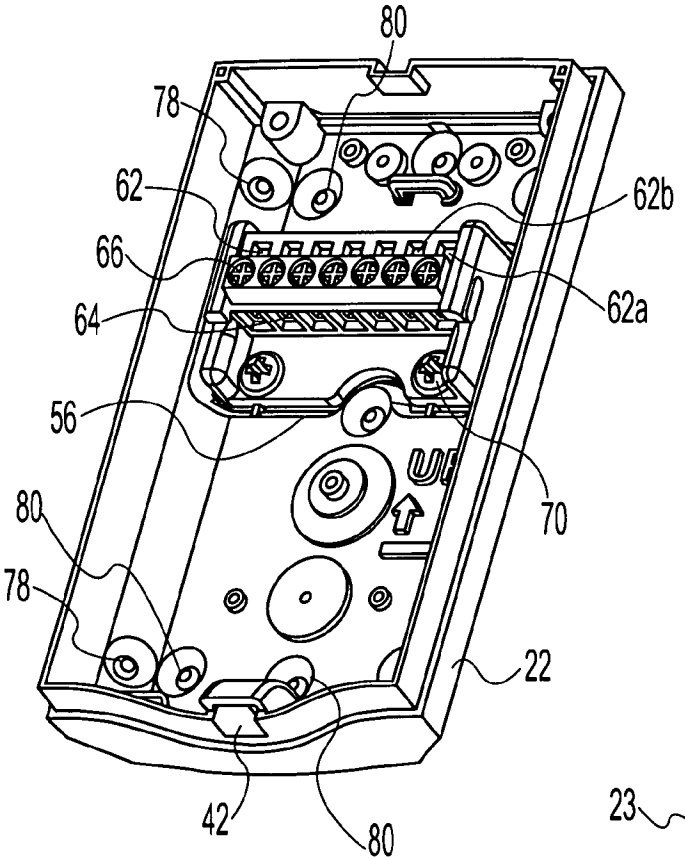
FIG. 3 is a view of the base housing of the device of FIG. 1.

As seen in FIGS. 3 and 4, first housing section 22 includes a detachable portion 50. Mounted on detachable portion 50 is a terminal assembly 60. Terminal assembly 60 includes a plurality of individual terminals 62. Each of the terminals 62 has associated with it, a port 64 and threaded fastener 66. Terminals 62, ports 64 and fasteners 66 have a conventional configuration well known to those having ordinary skill in the art wherein a conductive member, e.g., a wire 68, is insertable into one of the ports 64. The fastener 66 associated with the port 64 in which the wire 68 has been inserted is then tightened to secure the wire 68 in the port 64. The port 64 and terminal 62 are formed using conductive materials mounted in an insulating body, e.g., an outer plastic body which partially encases and separates an individual terminal and associated port from an adjacent terminal and port. When wire 68 is secured in port 64 an electrical connection between the associated terminal 62 and wire 68 is formed. The insertion of a conductive element, e.g., a conductive pin 30, into one of the terminals 62 establishes an electrical connection between the pin 30 and the terminal 62 and thereby also establishes an electrical connection between the wire 68 and pin 30. Terminals having alternative configurations for establishing an electrical connection with conductive elements on second housing section 24 may also be employed with the present invention.

As mentioned above, terminal assembly 60 is located on detachable portion 50. The detachable portion has a thickness that is substantially equivalent to the thickness of the majority of remainder 23 of the first housing section 22. In the illustrated embodiment, detachable portion 50 is integrally formed with the remainder 23 of first housing section. For example, first housing section 22, including detachable portion 50, may be formed by injection molding a plastic material. Detachable portion 50 defines an outer perimeter and is connected to the remainder 23 of the first housing section 22 by a frangible web of material 56. By utilizing a web of material 56 that has a thickness that is relatively thin and has a thickness less than the thickness of the detachable portion 50 and the remainder 23 of the first housing section 22 to which the web 56 is attached, web 56 provides a frangible connection between detachable portion 50 and the remainder 23 of first housing section 22. In the illustrated embodiment, first housing section 22, including detachable portion 50, are formed out of ABS using an injection molding process. Frangible web 56 has a thickness of approximately 0.015 to 0.020 inches (0.381 to 0.508 mm).

Figure 6:
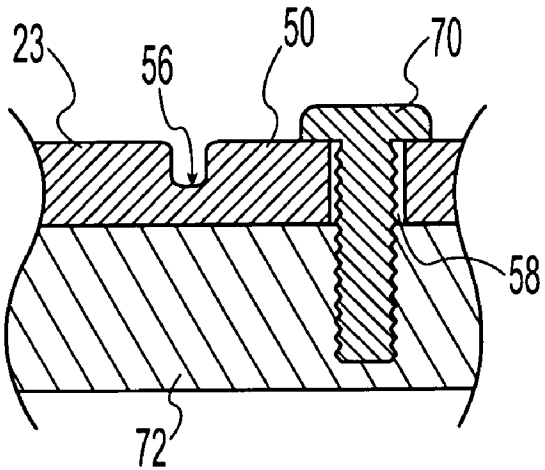
FIG. 6 is a partial schematic view of the printed circuit board used with the device.

Detachable portion 50 also includes two apertures 58 through which fasteners 70, e.g., screws, nails or other appropriate fastener, are inserted and which engage a support 72 such as an interior wall of a building as depicted in FIG. 6. Fasteners 70 thereby both secure detachable portion 50 to the support and also mount first housing section 22 and the entire security device 20 to the support. Although it is possible to mount security device 20 to a support using only fasteners 70 inserted through apertures 58 in detachable portion 50, additional fasteners inserted through features 78, 80 of first housing section may also be used to secure first housing section 22, and thus security device 20, to a support. When first housing section 22 is to be mounted on the planar surface of a wall or similar support, the rear surface of first housing section 22 will be seated flush against the planar wall or support surface and fasteners inserted through apertures 58 and features 80 will be used to secure device 20 to the wall. First housing section 22 also includes two edge portions that have rear surfaces disposed at a 45 degree angle to the central rear surface of first housing section 22. These edge portions can thereby sit flush against the two wall surfaces forming a corner when security device 20 is to be installed in a corner. In such a corner mounting position, fasteners are inserted through features 78 located on the angled edge portions of the first housing section 22. In such a corner application, fasteners 70 are still inserted through apertures 58 in detachable section 50 to directly secure detachable portion 50 to the wall. Because the rear surface of detachable portion 50 will not be flush against the wall, the fasteners 70 will extend for a short length between the rear surface of portion 50 and the walls before securely engaging the walls.

After mounting first housing section 22 to a wall or other support structure, wiring is attached to terminal assembly 60 to provide power to device 20 and also to provide communication between device 20 and a control panel (not shown) at a remote location. After attaching and wiring first housing section 22, the second housing section 24 is mounted to the first housing section 22. As the second housing section 24 is secured to the first housing section 22, pins 30 are inserted into ports 62 whereby the electronic components mounted on second housing section 24 can receive electrical power and communicate with the system as a whole, e.g., communicate with the control panel.

Figure 5:
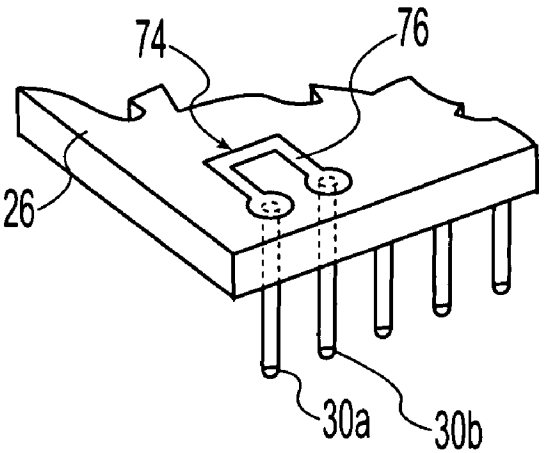
FIG. 5 is a partial cross sectional view of the base housing installed on a wall.

As schematically depicted in FIG. 5, a trace of conductive material 76 is formed on PCB 26 and provides electrical communication between two of the pins 30. In the illustrated embodiment, the two pins are first pin 30*a* and second pin 30*b* which project through PCB 26 to at least the layer which includes trace 76. When first pin 30*a* is inserted into first terminal 62*a* and second pin 30*b* is inserted into second terminal 62*b*, a tamper detection circuit 72 is defined between first and second terminals 62*a* and 62*b*. This tamper detection circuit acts like a switch, when pins 30*a* and 30*b* are inserted into terminals 62*a* and 62*b* the switch, defined by circuit 74, is closed and when one of the pins 30*a*, 30*b* are removed (in the illustrated embodiment, both pins 30*a*, 30*b* would be removed simultaneously) the switch, defined by circuit 74, is opened. Wires 68 in communication with terminals 62*a*, 62*b* to a remote location, e.g., a control panel located in a security room of the building can monitor whether pins 30*a*, 30*b* are still located within terminals 62*a* and 62*b* and an alarm signal can be generated if the tamper detection circuit 74 is opened. Thus, tamper detection circuit 74 may be used to monitor those types of tampering or sabotage that result in the removal of pins 30*a*, 30*b* from terminals 62*a*, 62*b*. In alternative embodiments, the PCB may also include a resistor element within tamper detection circuit 74 whereby any attempt to thwart the tamper detection system by using a conductive bridge between the two pins would also have to duplicate the resistor element, otherwise the change in voltage in the tamper line would be interpreted the same as opening the circuit. In the disclosed embodiment, pins 30*a*, 30*b* are located adjacent to each other, however, these pins may clearly also have alternative positions on PCB 26.

There are two main types of tampering or sabotage that device 20 may be subjected to that would result in the removal of pins 30*a*, 30*b* from terminals 62*a*, 62*b*. The first type of tampering is the removal of second housing section 24 from first housing section 22. Because PCB 26 and pins 30 are mounted in the second housing section 24, removal of this outer housing section 24 from the base or first housing section 22 will result in the removal of pins 30 from terminals 62. A second type of tampering that can be detected with device 20 is the forcible removal of device 20 from its support. For example, if an intruder were to pry device 20 from the wall or other support on which it was mounted, the frangible connection between detachable portion 50 and the remainder 23 of the first housing section 22 would likely be broken leaving detachable portion 50 and the terminal assembly 60 disposed thereon mounted on the support structure as the rest of device 20 was removed. This action would also result in the removal of pins 30, which would be separated from the support structure with the majority of device 20, from terminals 62 on terminal assembly 60, which would remain mounted on the support structure due to fasteners 70 securing detachable portion 50 to the support structure.

While detachable portion 50 has been described as being formed integrally with the remainder of the first housing section, alternative embodiments of the detachable portion may also be employed with the present invention. For example, detachable portion 50 may be formed separately from the remainder 23 of first housing section 22 and secured to first housing section 22 by a press-fit engagement, adhesives, or adhesive tape. Alternatively, detachable portion 50 and the remainder 23 of first housing section 22 may remain separate until the installation of device 20 and only be assembled together during the mounting of the device 20 on the support structure.

Although the present invention has been described with respect to devices used in an intrusion detection system, it may also be employed with various other systems in which it is desirable to detect the intentional, or unintentional, tampering or sabotage of the system. For example, the present system could also be utilized with a smoke or fire detection system to detect if any of the individual security devices, e.g., smoke detectors, has become dislodged, either intentionally or through an inadvertent impact which dislodges an individual detector.

While this invention has been described as having an exemplary design, the present invention may be further modified within the spirit and scope of this disclosure. This application is therefore intended to cover any variations, uses, or adaptations of the invention using its general principles.

What is claimed is:

1. A security device mountable on a support, said device comprising:

a base;

a housing, said housing including a removable section removably secured to said base, and a detachable portion adapted to be directly secured to said support, said detachable portion detachably secured to said base;

a terminal assembly including at least a first terminal and a second terminal, said terminal assembly being disposed on said detachable portion;

a first electrically conductive pin and a second electrically conductive pin disposed in said removable section of said housing, an electrically conductive strip providing electrical communication between said first and second conductive pins, said first and second conductive pins respectively engageable with said first and second terminals when said removable housing section is secured to said base, the respective engagement of said first and second conductive pins with said first and second terminals defining a tamper detection circuit whereby one of removal of said removable section from said base and detachment of said detachable portion from said base disengages said first and second conductive pins from said first and second terminals and opens said tamper detection circuit.

2. A security device mountable on a support, said device comprising:

a housing having a first section and a second section, said second section being removably attachable to said first section;

a terminal assembly including at least a first terminal and a second terminal;

a pin assembly having a first conductive pin and a second conductive pin, said first and second pins respectively insertable into said first and second terminals for establishing electrical contact between said first and second conductive pins;

a conductive strip providing electrical communication between said first and second conductive pins, the respective insertion of said first and second pins into said first and second terminals defining a closed tamper detection electrical circuit, the removal of one of said first and second pins from said first and second terminals opening said tamper detection circuit; and said first housing section including a detachable portion, said detachable portion adapted to be secured to a said support, said terminal assembly mounted on said detachable portion, said pin assembly disposed on said second housing section whereby detachment of said detachable portion from said first housing section disengages said pin assembly from said terminal assembly, attachment of said second housing section to said first housing section effects insertion of said first and second pins into said first and second terminals and removal of said second housing section from said first housing section effects disengagement of said first and second pins from said first and second terminals.

3. The security device of claim 2 wherein said terminal assembly, said pin assembly and said conductive material strip are all disposed in said housing when said second housing section is attached to said base.

4. The security device of claim 2 wherein said device includes a printed circuit board, said conductive material strip being formed on said printed circuit board.

5. The security device of claim 2 wherein said detachable portion is formed integrally with said first housing section.

6. The security device of claim 5 wherein said first housing further comprises a remainder, said detachable portion is connected to said remainder by a frangible web of material.

7. The security device of claim 6 wherein said first housing section is formed by injection molding a plastic material.

8. The security device of claim 2 wherein said detachable portion includes at least one aperture, said detachable portion being securable to the said support by inserting a fastener through said aperture.

9. The security device of claim 2 wherein each of said first and second terminals is adapted for connection to a wire whereby the opening of the detection circuit can be monitored at a location remote from the security device.

10. A tamper detection method for a security device mountable on a support, said method comprising:

providing a housing for the security device, the housing including a first housing section and a second housing section, said second housing section removably attachable to said first housing section;

providing the first housing section with a detachable portion, said detachable portion having a terminal assembly disposed thereon, the terminal assembly including a first terminal and a second terminal;

securing the detachable portion to the said support;

providing the second housing section with a pin assembly having at least a first conductive element and a second conductive element, said first and second conductive elements in electrical communication;

attaching the second housing section to the first housing section, said attaching step establishing respective electrical contact between the first and second conductive elements and the first and second terminals and thereby defining a closed tamper detection circuit between the first terminal and the second terminal; and monitoring the tamper detection circuit, and detecting tampering when the tamper detection circuit is opened, the tamper detection circuit being opened by the disengagement of one of the first and second conductive elements from the first and second terminals, disengagement of the first and second conductive elements from the first and second terminals being effected by removal of the security device from the said support and by removal of the second housing section from the first housing section.

11. The method of claim 10 further comprising providing the security device with a printed circuit board wherein the tamper detection circuit defines a portion of the printed circuit board.

12. The method of claim 10 wherein providing the first housing section with a detachable portion includes connecting the detachable portion to a remainder of the first housing section with a frangible web of material.

13. The method of claim 12 further comprising forming the first housing section by an injection molding process.

14. The method of claim 10 wherein the step of securing the detachable portion to the support includes inserting a fastener through the detachable portion and securing the fastener to the support.

15. The method of claim 10 further comprising the step of connecting a first conductive member to the first terminal and a second conductive member to the second terminal and monitoring the tamper detection circuit for opening of the circuit at a location remote from the security device.

* * * * *